US005105396A

United States Patent [19]

Ganter et al.

[11] Patent Number: 5,105,396

[45] Date of Patent: Apr. 14, 1992

[54] AUTONOMOUS RADIO TIMEPIECE

[75] Inventors: Wolfgang Ganter, Schramberg; Wolfram Hodapp, Schenkenzell, both of Fed. Rep. of Germany

[73] Assignee: Junghans Uhren GmbH, Schramberg, Fed. Rep. of Germany

[21] Appl. No.: 694,690

[22] Filed: May 2, 1991

[30] Foreign Application Priority Data

May 4, 1990 [DE] Fed. Rep. of Germany ... 9005073[U]

[51] Int. Cl.[5] ..... G04C 11/02

[52] U.S. Cl. ..... 368/47

[58] Field of Search ..... 368/46, 47, 49, 51, 368/59

[56] References Cited

U.S. PATENT DOCUMENTS

| | | | |
|---|---|---|---|
| 4,582,434 | 4/1986 | Plangger et al. | 368/46 |
| 4,645,357 | 2/1987 | Allgaier et al. | 368/47 |
| 4,650,344 | 3/1987 | Allgaier et al. | 368/187 |
| 4,823,328 | 4/1989 | Conklin et al. | 368/47 |

FOREIGN PATENT DOCUMENTS

| | | |
|---|---|---|
| 3731956 | 4/1989 | Fed. Rep. of Germany . |
| 8815967.1 | 11/1989 | Fed. Rep. of Germany . |

*Primary Examiner*—Vit W. Miska

*Attorney, Agent, or Firm*—Burns, Doane, Swecker & Mathis

[57] ABSTRACT

An autonomous radio timepiece (1), in particular small, portable timepiece such as a travel alarm clock or a wrist watch includes a display (25) of the prevailing radio field intensity. The display (25) is capable of simultaneously signaling the actuation of a receiver (14) for the decoding of absolute time information and is conveniently combined, in the form of a bar graph, with day indicator flags adjacent a day-of-the-week display (26). When operating outside the time zone for which the transmitter emits the coded absolute time information, the time piece may be manually switched to the instantaneously prevailing time zone. The number of time zone changes may be entered and displayed, or the prevailing hour (H) of the time zone involved is entered, from which an electro-mechanical time display (18) then continues to advance.

19 Claims, 2 Drawing Sheets

AUTONOMOUS RADIO TIMEPIECE

BACKGROUND OF THE INVENTION

1. Field of the Invention

The invention concerns an autonomous radio timepiece wherein a time display, maintained by an autonomous internal time keeping circuit, is corrected by radio transmitted, absolute time information.

2. Description of Related Art

A radio timepiece is known for example from U.S. Pat. No. 4,650,344 issued to Allgaier et al on Mar. 17, 1987, herein incorporated by reference. The radio timepiece disclosed in this patent includes an electromechanical time display wherein, for example, the angular positions of hands are based on the stepping movement provided by an internal time keeping circuit. In operation, the patented radio timepiece determines from time to time whether the instantaneous electromechanical time display coincides with the prevailing absolute time. The absolute time is emitted in coded form by a transmitter separate from the timepiece and decoded by a receiver, which is built into the timepiece and tuned to said transmitter. If necessary, the time display is corrected on the basis of the complete, decoded absolute time information received. In order to be able to determine whether any display correction may be expected (upon the activation of the timepiece, i.e., in case of a randomly incorrect display, or following the actuation of the so-called "transmitter call button") by means of received radio information, an indicator hand is provided on each radio timepiece. The indicator hand is stepped forward initially at the cycle time of the coding frequency received, until absolute time information has been decoded for the correction of the time display. Any irregular motion of the indicator hand is an unerring indication of the fact that no undisturbed reception of the time information coded in seconds rhythm is possible and that therefore no setting or correction of the time display is to be expected under the prevailing receiving conditions. This is correspondingly true if, following a reset, the seconds information received and decoded is displayed digitally but is not counted up from 1 to 59 without interference in the seconds rhythm.

It is known from DE-OS 37 31 956 to indicate by means of at least one electro-optical display the number of unsuccessful receiver actuations (decoding attempts) already performed. If these indications appear, for example, during the autonomous operation of the radio timepiece in the programmed hourly rhythm, the display provides information relative to the number of hours during which it has not been possible to monitor and eventually correct the prevailing time display by means of received absolute time information.

However, for small portable timepieces in particular, such as travel alarms or wrist watches, it is of special interest to be able to estimate whether under the prevailing operating conditions a reception of decodable automatic absolute time information may be expected at all, or whether the manual actuation of the receiver would be futile. This is so even if no indicator hand stepping in the seconds rhythm is available and without interrupting the autonomously advancing time display.

OBJECTS AND SUMMARY OF THE INVENTION

Based on the above considerations, it is an object of the present invention to provide a radio timepiece of the aforementioned type which provides a receiving signal display containing more information relative to operational readiness than, for example, the fact that several futile attempts at radio reception were made.

This object is attained by means of a radio timepiece of the aforementioned generic type which is equipped with an receiving field intensity display.

According to this solution, the receiving field intensity actually present at the location of the radio timepiece is measured and displayed. If the field intensity of the time information emitter received over the timepiece antenna is too weak, no decoding without interference of absolute time information for the monitoring and eventual correction of the instantaneous time display may be expected. Frequently, in such a circumstance, a partial temporary realignment of the receiving antenna is sufficient to immediately determine, by a corresponding change in the receiving field intensity displayed, whether adequate receiving conditions for the decoding of absolute time information are present.

When a radio timepiece is equipped with an optoelectronic display for the display of time derived information, it is convenient to provide a field intensity display in the form of a so-called bar diagram. The instantaneously displayed length of bar diagram is a function of the prevailing receiving field intensity. A bar graph display of this type may also be switched over to display other variables of interest for the operation of the timepiece, such as, for example, the temporary display of the battery voltage level, so that a new power source may be inserted prior to depletion of the existing battery. Also, providing a timepiece with an incremental bar graph makes it possible to use the bar elements as individual bounce indications (so-called flags). With these flag elements, the prevailing day may be marked against a days-of-the-week scale, for example. The prevailing day information may be obtained from a calendar stepping circuit and/or from the absolute time information transmitted by radio.

Conveniently, the blinking of the bar graph field intensity display will indicate that the receiver is instantaneously actuated. The actuation of the receiver takes place automatically in a known manner at predetermined points in time during the autonomous operation of the timepiece. The autonomous operation of the timepiece and the determination of the predetermined points in time is provided by an internal timekeeping circuit. The receiver may actuated manually by means of the so-called JUNGHANS "sender call button".

Another aspect of the present invention provides a time zone switch on a portable radio timepiece of this type for operation according to absolute time information at the edge or beyond the limits of the time zone for which the coded absolute time information transmitted by radio. A radio timepiece of this type is usefully equipped with a time zone switch to alter, if necessary, the time indication decoded from the radio information by zone steps, if the timepiece leaves the time zone provided with the aforementioned transmitter or returns to it. For this purpose, a direct manual switching of the hour display may be provided. This manual switching causes a constant, predetermined hour shift relative to the possibly still receivable and decoded hour information, with the display of the altered time and absolute time derived variables progressing without change. In other words, once the hour display is shifted, later reception and decoding of absolute time information will not cause the shifted hour display to shift back.

The number of time zones over which the manual shift has taken place may be indicated in this embodiment. However, as electro-mechanical time displays for reasons of gearing technology cannot be altered at an arbitrary rate, i.e., the manual time zone shift cannot be effected instantaneously, it is more convenient in this case to display the hour belonging to the future time zone directly by means of time zone switches, as the new prevailing standard hour, into which the electro-mechanical time display enters in the same manner as in the case of a correction due to an absolute time information differing from the instantaneous display. Time zone switches of this type are significant in themselves, even independently of the presence of a field intensity indication in an autonomous radio timepiece.

BRIEF DESCRIPTION OF THE DRAWINGS

Additional alternatives and further developments, together with further characteristics and advantages of the invention will become apparent from consideration of the attached claims, the summary of the invention, the following description of a preferred embodiments and the drawings, in which:

DESCRIPTION OF THE PREFERRED EMBODIMENTS

Figure 2:
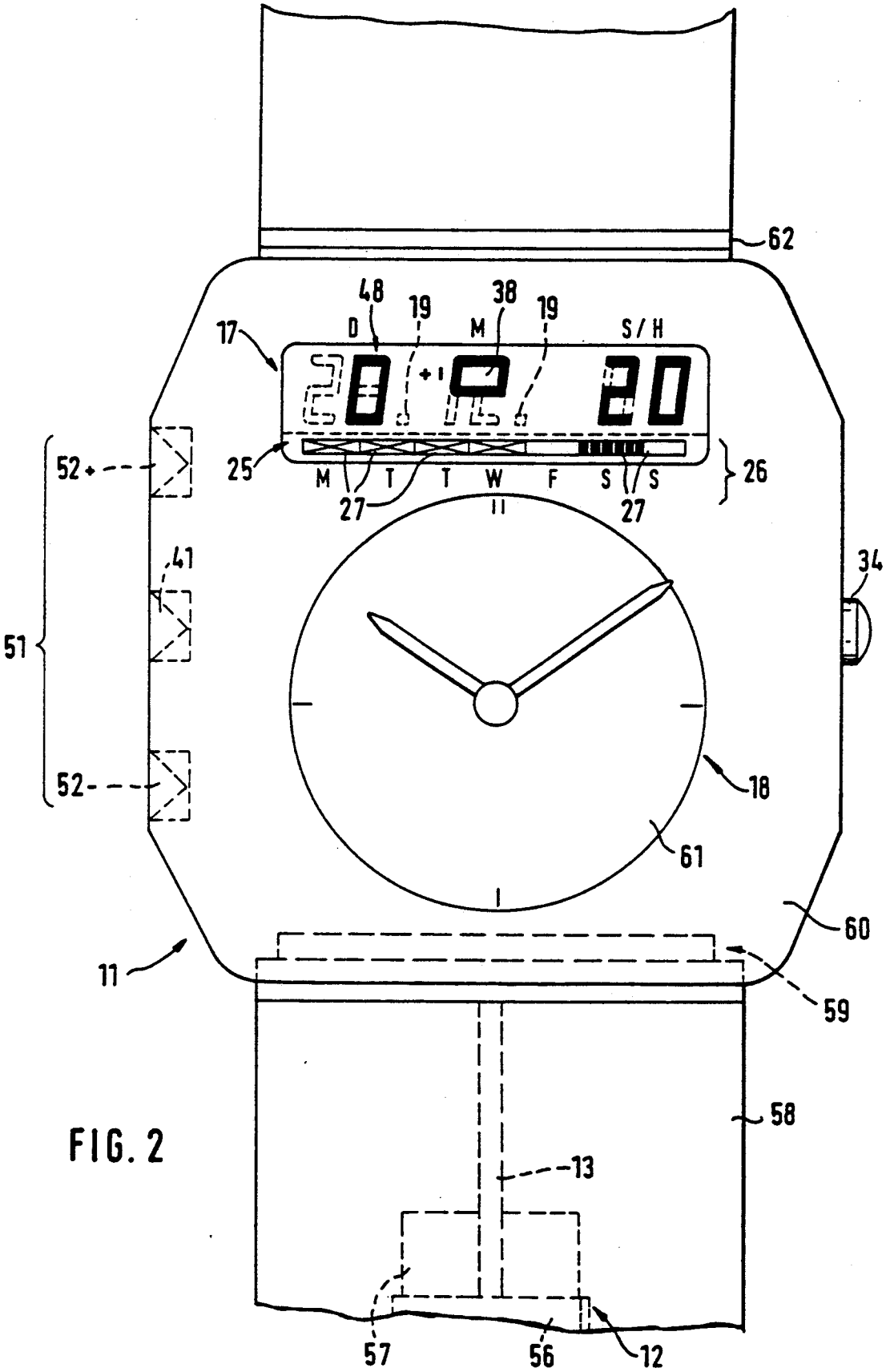
FIG. 2 an enlarged configuration of the radio timepiece according to FIG. 1 in the form of a radio wrist watch.

The radio timepiece 11, schematically shown relative to the circuit layout in the drawing, is equipped with a miniaturized antenna 12, which feeds received signals through an antenna line 13 to a receiver 14. The receiver 14 is tuned to at least one transmitter (not shown), which is usually operated in the long wave frequency range and which quasi—continuously emits coded absolute time information. This information is demodulated in the receiver 14 and converted in a decoder 15 into digitalized time information, which is passed on to display control circuit 16. The display control circuit 16 controls a multiple position digital display 17. Additionally, if an analog display 18 is provided to indicate the prevailing hour and minute, it is not necessary to include this information in the digital display 17 and the digital display 17 may then be restricted to two digit displays of day, month and second D, M, S. In this embodiment, to simplify interpretation, both of the first two groups D, M are followed by an ordinal point 19 (FIG. 2). Of course, other arrangements of the digits on the digital display are possible.

As described in more detail in the aforecited U.S. Pat. No. 4,650,344, an electro-mechanical display 18 is equipped with detector 20 operating in a coding or incremental manner, in order to compare the prevailing mechanical display setting (i.e. the instantaneous time display) in a comparator 21 with the received and decoded absolute time information to be displayed. In case of an erroneous display, the detector 20 actuates a change-over switch 22 to activate an electro-mechanical converter 23 (for example, a timepiece stepping motor) with a setting frequency f2 of an autonomous internal timekeeping circuit 24, until the mechanical time display 18 is again in agreement with the absolute time information provided. The comparator 21 then reverses the switch 22 and the converter 23 is cycled forward with the timekeeping frequency F1. The setting frequency f2 is not equal to and is preferably greater than the timekeeping frequency f1.

In order to indicate to the observer that the timepiece 11 is attempting to receive coded time information, i.e., that the receiver 14 is activated, a receiving display 25 is provided. The receiving display 25 is preferably in the form of a blinking display between or adjacent to the digits of the opto-electronic display 17. If a days-of-the-week display 26 is equipped with flags 27 correlated with weekday abbreviations (as shown in FIG. 2 with English language abbreviations M, T, T, W, F, S, S for the days Monday to Sunday), it is possible to modulate the bright activation of the appropriate flag 27 by means of a flag control circuit 28 through a signal modulator 29 by periodic interruptions. The modulations of the brightness of the flags 27, i.e., the blinking of the flags 27, can be done if and while the receiver 14 is activated for reception or continuously, or upon activation of a switch (not shown).

In particular, in the case of a small portable radio timepiece such as those with the configuration of a travel alarm or a wrist watch, the radio timepiece 11 is not operated in a stationary setting and it is of particular interest for the user to know whether under the prevailing operating conditions the available receiving field intensity is adequate for the operation of the receiver 14, should the receiver 14 be activated. To this end, the antenna 12 is followed in line before or after the amplifying receiver 14 by a field level meter 30 capable of actuating the sequence of all day flags 27 by means of an display intensity control circuit 31, to display field intensity in the manner of a bar graph display. When the display 17 is switched over (for example by means of a push button 34 or the actuation for a predetermined period of time of a switch 41 provided for other functions), a number of subsequent flags 27 (visualized in FIG. 2 by crossing diagonals) appear adjacent to each other, the number thereof being a function of the prevailing level of the receiving field strength. It is expedient here to modulate this display also, for example, by periodically darkening it (i.e., blinking) by means of a signal modulator 29, if and while the receiver 14 is activated.

The switching between the special bar graph field strength display in the opto-electronic display 17 (according to FIG. 2) and the normal date, second and day-of-the-week display (underlined with a broken line in FIG. 2) is effected preferably by means of a operating mode change-over switch 32 with a control stage 33, which among other means may be set by the manually actuated push button 34. Simultaneously, a reset inlet 35 is actuated to reset the operating change-over switch 32 by the control stage 33 (following a waiting period determined by the circuitry and beginning at the latest SET actuation), whereby an internal time circuit 24 is activated to set the regular opto-electronic date and seconds indication on the display 17.

Part of the opto-electronic display 17 may be used to indicate, if necessary, that the operating voltage of the power source 36 is critically low, and thereby indicate that a power source 36 such as a buffered solar cell, for example, should be exposed to radiation or a battery should be replaced as soon as possible to prevent the deactivation of the timepiece 11. Accordingly, a voltage detector 37 is provided, which operates as a voltage meter, for example.

If the display position detector 20 uses light emitting diodes and light barriers, as described for example in U.S. Pat. No. 4,645,357 issued to Allgaier et al on Feb. 24, 1987 (herein incorporated by reference) in more detail for hand mechanisms, it is functionally safer to query the voltage dependent functions threshold by means of the voltage detector 37 and to cause warning information 38 (by way of the display control circuit 16) to appear on the display 17. The warning information 38, in a preferred embodiment, appears in the upper half of the month indication M. The warning information 38 may be in the form of a battery symbol (as shown in FIG. 2, top), for example, and may be placed elsewhere in the display 17 in other embodiments.

As realized by the dynamic inlet in the center of the OR gate 39, the receiver 14 is actuated whenever the timepiece 11 is activated, for example, by the insertion of a fresh power source 36. Actuation may also take place upon a response by a query circuit 40, preset for certain points in time (for example, at each full hour of the prevailing time). However, if a radio wrist watch 11 is involved, it is more appropriate to provide only a few points in time during the night as the actuation points of the receiver in the query circuit 40. If the radio wrist watch 11 is worn during the day, the movements of the wearer may lead to field strength fluctuations in the receiving antenna 12 which are superposed on the amplitude modulated coding of the time information received, thereby falsifying the coding and preventing the decoding of the instantaneous time information, even though the receiving field intensity would otherwise be adequate. Such irritations to the wearer and the unnecessary energy consumption by the functional but futile actuation of the receiver 14 are avoided if the actuation times are set well into the night, when the radio wrist watch 11 is not typically worn, or at least the arm of the wearer is typically at rest.

Finally, the receiver 14 may also be actuated manually by means of a so-called sender call button 41, which in order to prevent erroneous actuations is preferably recessed into the case 60 of the timepiece 11 (FIG. 2).

Figure 1:
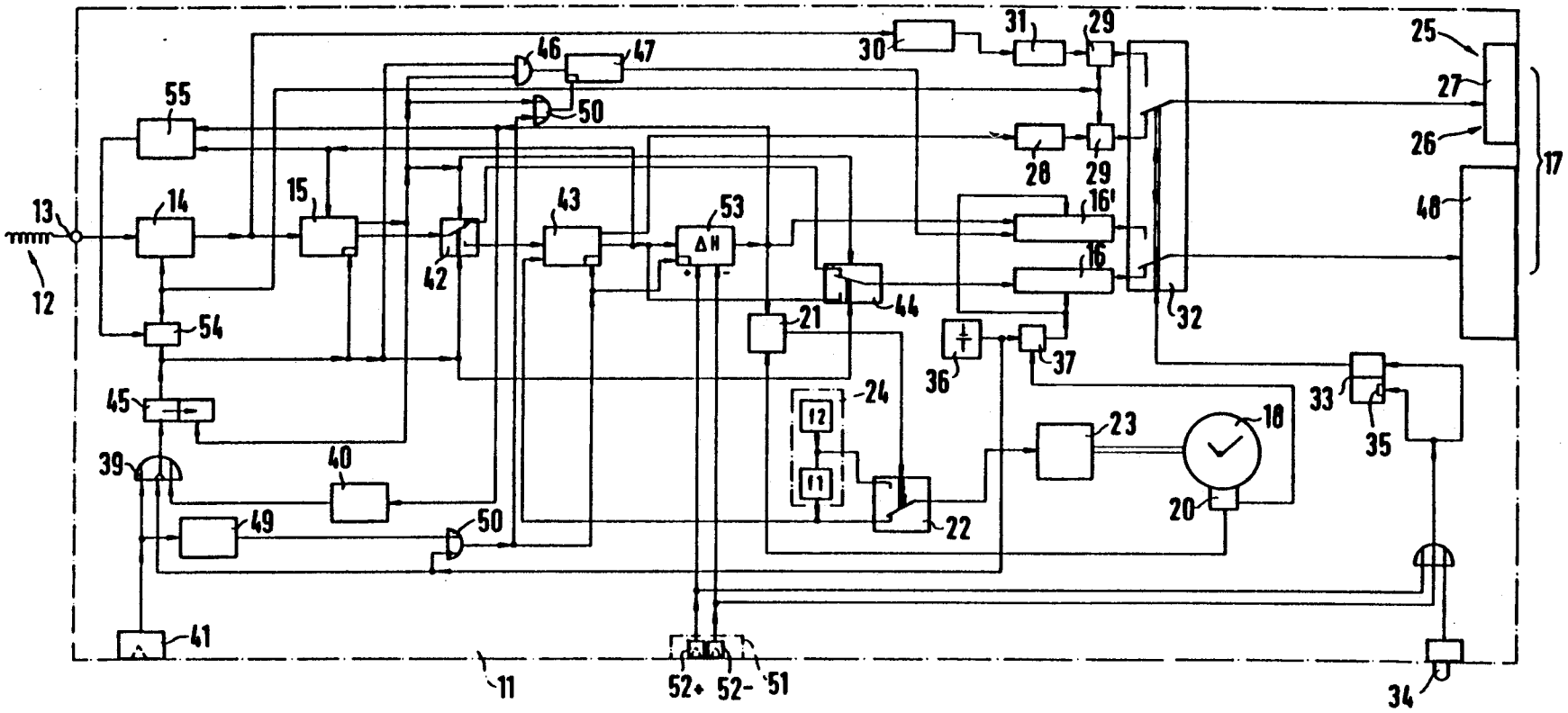
FIG. 1 shows in a block diagram the circuitry of one embodiment a radio timepiece according to the present invention.

Upon each actuation of the receiver 14, a separating switch 42 is opened between the decoder 15 and a register 43. The register 43 is set, in case of decoding of a plausible instantaneous time information, based on the received information and then cycled forward by a time keeping circuit 24 for the continuous determination of time. It may, however, be expedient to show the duration of the actuation of the receiver 14 in the opto-electronic display 17. The receiver actuation may be shown in part of the display, for example, in the two-digit date range in place of the usual (date) display, by flashing the partial display according to the seconds information determined by the decoder 15 and with the ordinal point 19, in order to be able to observe the synchronization process in the course of the reception of the time information. As indicated in FIG. 1, this is accomplished by means of an observation switch 44 in the supply line of the display control circuit 16.

The actuation of the receiver 14 is interrupted by a switching system 45 if the decoder 15 has been able to decode an instantaneous time information and therefore has reset the switches 42, 44 into their normal display function, or if after a certain receiving time period (preset in the switching system 45) such a plausible instantaneous time information has not been obtained by the decoder 15. The plausibility criterion is a defined time difference between an instantaneous decoded time information received and an earlier reference time information or one obtained from the forward cycling time register 43.

The occurrence of a receiver actuation and deactivation without decoding of valid time information are detected in an inhibit-logic-gate 46 and summed by a counter 47, the prevailing count of the counter 47 being displayed numerically in the display 17 when switched to sender display by the corresponding actuation of the display control circuit 16'; for example, the number of attempted receptions maybe shown by the digits 48, which includes with at least one of the digits which normally displays the day D on the display 17 (as shown in FIG. 2, left top). The indication the number of attempted receptions thus always remain at "zero" if (within the range of reception of the time information transmitter) all actuations of the receiver 14—manual or automatic—lead to the decoding of instantaneous time information.

Any time the receiver 14 is deactivated, without a confirmed reception of time information (i.e., without instantaneous absolute time information having been obtained in the decoder), the old time information internally cycled in the register 43 in a time keeping manner is again passed to the display 17 by the display control circuit 16. This insures that the correct (although not confirmed by radio) time is being displayed even if, for example, due to interference effects or because the transmitter is deactivated, the reception and decoding of radio time information is not possible at the moment.

If, however, the sender call button 41 remains actuated over a predetermined longer period of time, which is detected by a time element 49, a complete reset of the circuit layout and the program takes place with the actuation of the receiver 14, together with the reset of all registers, including the advancing time register 43. In this manner therefore all displays are returned into their zero positions and the operation of the timepiece again begins with the counting and display of the advancing seconds decoded from the radio information. The OR logic gates 50 in FIG. 1 cause this actuation of the sender call button 41 to express the fact that this trigger the same initial operating state as that occasioned by the replacement of the power source 36.

A transmitter for the emission of coded absolute time information relates the time information to a certain geographic time zone, usually the time zone in which the transmitter itself is operated. It may be assumed that in the adjacent edges of the neighboring time zones on either side the transmitter may still receive time transmissions with an adequate field intensity for the operation of the receiver 14 through the antenna 12. This, however, is certainly not true if the timepiece 11 is operated beyond the time zones adjacent on either side to the zone in which the transmitter (to which the receiver 14 is tuned) is located. Here, the advancing time display 18, including the supplemental displays on the display 17, operate only out of the time register 43 advancing in a time keeping manner.

In order to alter the time display showing a deviation from the transmitter information by the number of display units corresponding to the number of time zone changes, i.e., to adapt the time display to the local time in the time zone in which the timepiece 11 is now located, a manually actuated zone switch 51 is provided. The actuation of the switch 51 causes the register 53 operating the display control circuit 16 to be advanced or retarded by full hours (without affecting the prevailing minute and seconds indications, but with consideration of calendar day changes) for example by means of the actuation of the push buttons 52+, 52− recessed into the case 60. To enhance the clarity of the layout, this addition or subtraction of full hours is shown in the block diagram of FIG. 1 by an adapting register 53 following the time register 43 in line.

In the time zone adjacent to the transmitter one hour is deducted from or added to the hour information received. However, as soon as this manual time zone adaptation amounts to more than one time zone, i.e., to regions in which a safe reception of the transmitter can no longer be expected, the actuation of the receiver 14 is blocked by means of a gating circuit 54 in order to relieve the power source. The gating circuit 54 is actuated by the output of a comparator 55, which switches the gating circuit 54 on when the manually effected hour change returns to less than plus or minus 2. This output is obtained, for example, from a comparison of the hour information before and after the adapting register 53.

In order to prevent errors, the actuation of one of the time zone push buttons 52—as does the above-mentioned activation of a potentially present change-over push button switch 34—changes the display on the opto-electronic display 17 from the date and seconds indication of the prevailing time (dotted line on top of FIG. 1) to the aforementioned auxiliary display of digital display 17. In the auxiliary display of digital display 17, for example, in the two "seconds" digits, it may be indicated by means of the display control circuit 16' how many adding or deducting actuations of the push button 52 had been effected, i.e., by how many time zones to the east or the west the time display is to be modified relative to the time zone of the transmitter. However, for reasons of mechanical gearing the subsequent adjustments of the electro-mechanical flags or the hands display 18 by means of the increased setting frequency f2 cannot be carried out at an arbitrary velocity, and if a rapid mechanical movement is possible in one direction only, in case of a 12-hour display 18, for example a change by minus two time zones requires ten complete revolutions of a minute hand coupled with the hour hand. Therefore, while the entry of the time zone change may be carried out rapidly by means of the push button 52, it may be irritating that the electro-mechanically advanced hands or numbers do not follow the change immediately.

Consequently, it may be more convenient in the auxiliary display of the display 17 not to indicate the change in time zones (in hours) relative to the prevailing time, but to carry out with the two digits of the seconds display in this change-over switching state a genuine (desired) hour display H to correspond directly to the prevailing hour in the new intended time zone. Relative to the aforementioned example, after actuating the minus push button 52− twice, "−2" will not be indicated to the right in the switched-over display 17, but (relative to the position of the hand according to FIG. 2) the new set time zone hour "20" will be displayed (without consideration of the unaffected minutes and seconds). This is the set hour display for the mechanical display 18 entered by means of the comparator 21, while the minutes and seconds required for this setting process are being advanced. In the switched-over display 17 therefore to the right an hour indication always appears, which is in agreement with that of the time information received (and of the electro-mechanical display 18), if no manual time zone shifts have been entered.

The functions visualized in the drawing in the manner of a block diagram may be carried out to a great extent in a processor, which is provided primarily for the receiver and display actuation on the basis of the demodulated and decoded absolute time information.

The antenna 12 of the radio timepiece is conveniently provided in the form of a magnetic antenna consisting of a flat coil 56 on a flexible core 57 connected with the antenna line 13, such as described for example in more detail in DE-GM 88 15 967. This antenna 12 may be included in a wristband 58 and connected by means of a combination plug-in and fastening device 59 electrically and mechanically with the case 60 of the radio wristwatch 11. If the latter according to the preferred example of embodiment shown (FIG. 2) is a hybrid timepiece, i.e., equipped with a combination of an electro-mechanical display 18 and an electro-optical display 17, the latter is located preferably—in contrast to the usual configuration of such hybrid timepieces—not below but above the electro-mechanical hands display 18. In this manner, at the lower edge of the case 60 under the lower range of the minute mechanism 61, sufficient space is available for the provision of the counter piece to the plug-in and fastening device 59 of the wristband 58, so that this part of the wristband 58, which is somewhat more rigid and thicker due to the insertion of the antenna 12, will be located in a desirable manner on the inside of the arm of the wearer. Opposite this, adjacent to the space for the installation of the display 17, the part of the wristband not equipped with an antenna is articulated by means of a conventional hinge 62 onto the edge of the watch case 60.

We claim:

1. An autonomous timepiece comprising:

an internal timekeeping circuit for generating an autonomous time signal;

a radio receiver for receiving radio transmissions of time information and generating an absolute time signal;

a register for registering time according to said absolute time signal when said radio receiver is activated and according to said autonomous time signal when said radio receiver is not activated, whereby the received time information corrects any deviation in the registered time according to the absolute time signal and the autonomous time signal advances the registered time when said receiver is not activated; and a display for displaying the registered time and for displaying the field intensity of the time information transmission.

2. Radio timepiece according to claim 1, wherein the field intensity display is in the form of a bar graph.

3. Radio timepiece according to claim 1, wherein said display includes a day-of-the-week display and said field intensity display includes elements, wherein said elements also act as flags of said day-of-the-week display.

4. Radio timepiece according to claim 2, wherein said display includes a day-of-the-week display and said field intensity display includes elements, wherein said elements also act as flags of said day-of-the-week display.

5. Radio timepiece according to claim 3, wherein said display includes a day-of-the-week display and said field intensity display includes elements, wherein said elements also act as flags of said day-of-the-week display.

6. Radio timepiece according to claim 1, further comprising a modulator for modulating said field intensity display during the actuation of a radio receiver.

7. Radio timepiece according to claim 2, further comprising a modulator for modulating said field intensity display during the actuation of a radio receiver.

8. Radio timepiece according to claim 3, further comprising a modulator for modulating said field intensity display during the actuation of a radio receiver.

9. Radio timepiece according to claim 4, further comprising a modulator for modulating said field intensity display during the actuation of a radio receiver.

10. Radio timepiece according to claim 5, further comprising a modulator for modulating said field intensity display during the actuation of a radio receiver.

11. Radio timepiece according to claim 1, further comprising means for determining the number of radio receptions said receiver has attempted but were futile, and wherein said display further indicates the number of past futile reception attempts, said indication optionally blinking during the actuation of said radio receiver.

12. Radio timepiece according to claim 11, wherein said display has a normal display mode and an auxiliary display mode, said display includes an opto-electronic display section and wherein the indication of the number of attempted receptions is provided on said opto-electronic display section when said display is manually switched to its auxiliary display mode.

13. Radio timepiece according to claim 12, wherein said opto-electronic display section includes day digits corresponding to current day and wherein the number of attempted receptions is indicated by at least one of the day digits of the opto-electronic display when said display is in its auxiliary display mode.

14. Radio timepiece according to claim 1, further comprising a manual switch for switching said display between a normal display and an auxiliary display, and, in the case of said display is manually switched from its normal display, manually variable time zone information may be displayed.

15. Radio timepiece according to claim 14, wherein said display displays a time zone difference between a received time information and a prevailing hour of a local time zone.

16. Radio timepiece according to claim 14, wherein said display includes an electro-mechanical time display section and a digital display section, and wherein a prevailing hour of the local time zone may be displayed digitally and serve as the reference information for the adjustment of an electromechanical time display section.

17. Radio timepiece according to claim 1, further comprising a case for housing the radio timepiece, a wristband for securing said case to an object, an antenna for receiving radio transmissions and integrated into wristband, and a connecting device for connecting said antenna mechanically to said case and electronically to said radio timepiece, wherein said display includes an electromechanical time display and a manually switchable opto-electronic display, said opto-electronic display located, relative to the electro-mechanical display, diametrically opposite said electrical and mechanical connecting device of said antenna.

18. Radio timepiece according to claim 2, further comprising a built-in power source, wherein the bar graph may be switched to display the capacity of a built-in source of power.

19. Radio timepiece according to claim 1, further comprising a built-in power source, and wherein said display includes a digital display section with a switchable opto-electronic display, said opto-electronic display section displaying warning information when said built-in power source is critically low.

* * * * *

US005105396A

REEXAMINATION CERTIFICATE (2141st)

United States Patent [19]

[11] B1 5,105,396

Ganter et al.

[45] Certificate Issued Nov. 30, 1993

[54] AUTONOMOUS RADIO TIMEPIECE

[75] Inventors: Wolfgang Ganter, Schramberg; Wolfram Hodapp, Schenkenzell, both of Fed. Rep. of Germany

[73] Assignee: Junghans Uhren GmbH, Schramberg, Fed. Rep. of Germany

Reexamination Request:
No. 90/002,821, Aug. 24, 1992

Reexamination Certificate for:

| | |
|---|---|
| Patent No.: | **5,105,396** |
| Issued: | **Apr. 14, 1992** |
| Appl. No.: | **694,690** |
| Filed: | **May 2, 1991** |

[51] Int. Cl.[5] ..... G04C 11/02
[52] U.S. Cl. ..... 368/47
[58] Field of Search ..... 368/10, 21, 46, 47, 368/49, 51, 59, 66, 187, 11; 455/12, 181, 230, 344

[56] References Cited

U.S. PATENT DOCUMENTS

| | | | |
|---|---|---|---|
| 4,236,237 | 11/1980 | Ichikawa | 368/66 |
| 4,262,345 | 4/1981 | Ganter et al. | 368/29 |
| 4,312,056 | 1/1982 | Nishimura | 368/62 |
| 4,315,332 | 2/1982 | Sakami et al. | 368/47 |
| 4,582,434 | 4/1986 | Plangger et al. | 368/46 |
| 4,645,357 | 2/1987 | Allgaier et al. | 368/47 |
| 4,650,344 | 3/1987 | Allgaier et al. | 368/187 |
| 4,681,460 | 7/1987 | Nishimura | 368/21 |
| 4,823,328 | 4/1989 | Conklin et al. | 368/47 |
| 4,860,268 | 8/1989 | Allgaier et al. | 368/47 |
| 5,036,500 | 7/1991 | Ganter | 368/47 |
| 5,077,706 | 12/1991 | Ganter | 368/47 |
| 5,083,123 | 1/1992 | Ganter et al. | 368/47 |

FOREIGN PATENT DOCUMENTS 2802040 7/1979 Fed. Rep. of Germany .

*Primary Examiner*—Vit W. Miska

[57] ABSTRACT

An autonomous radio timepiece (1), in particular small, portable timepiece such as a travel alarm clock or a wrist watch includes a display (25) of the prevailing radio field intensity. The display (25) is capable of simultaneously signaling the actuation of a receiver (14) for the decoding of absolute time information and is conveniently combined, in the form of a bar graph, with day indicator flags adjacent a day-of-the-week display (26). When operating outside the time zone for which the transmitter emits the coded absolute time information, the time piece may be manually switched to the instantaneously prevailing time zone. The number of time zone changes may be entered and displayed, or the prevailing hour (H) of the time zone involved is entered, from which an electro-mechanical time display (18) then continues to advance.

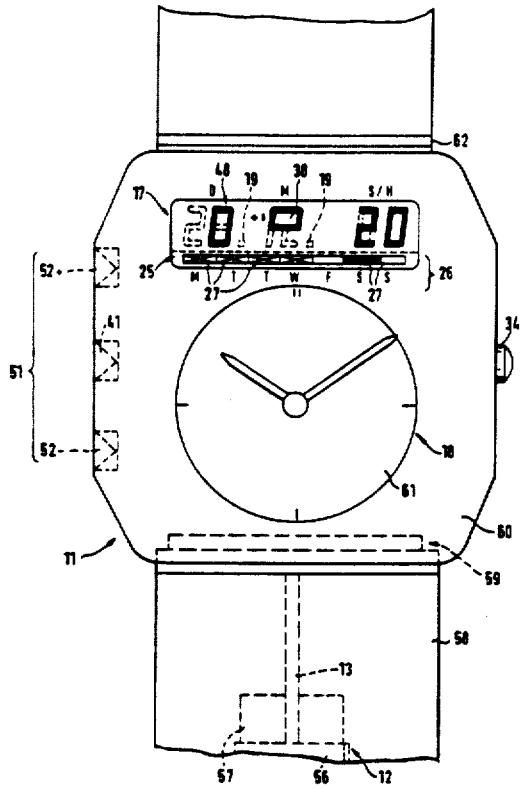

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 5, 10 and 14 are cancelled.

Claims 1-4, 6-9, 11-13 and 15-19 are determined to be patentable as amended.

1. An autonomous *radio-controlled* timepiece comprising:

an internal timekeeping circuit for generating an autonomous time signal;

a radio receiver for *periodically* receiving radio transmisions of *coded absolute* time information and [generating] *decoding therefrom* an absolute time signal;

*a time display including an analog display with hands for at least indicating hour and minute time information, and an auxiliary digital display for displaying further information;* a register for register time according to said absolute time signal when said radio receiver is activated and according to said autonomous time signal when said radio receiver is not activated, whereby the received time information corrects any deviation in the registered time *and in the time actually indicated by the analog display hands* according to the absolute time signal and, *whereby* the autonomous time signal advances the registered time when said receiver is not activated. [; and a] *wherein said* display [for displaying] *displays* the registered time and [for displaying] the field intensity of the time information transmission; *and*

*a switch for manually varying the registered time according to time zone increments and for temporarily switching said auxiliary digital display from a normal display mode wherein said further information is displayed to an auxiliary display mode wherein time zone information is displayed while the analog display hands are being mechanically positioned to the manually varied registered time.*

2. *An autonomous radio-controlled* [Radio] timepiece according to claim 1, wherein the field intensity display is in the form of a bar graph.

3. *An autonomous radio-controlled* [Radio] timepiece according to claim 1, wherein said display includes a day-of-the-week display and said field intensity display includes elements, wherein said elements also act as flags of said day-of-the-week display.

4. *An autonomous radio-controlled* [Radio] timepiece according to claim 2, wherein said display includes a day-of-the-week display and said field intensity display includes elements, wherein said elements also act as flags of said day-of-the-week display.

6. *An autonomous radio-controlled* [Radio] timepiece according to claim 1, further comprising a modulator for modulating said field intensity display during the actuation of [a] *said* radio receiver.

7. *An autonomous radio-controlled* [Radio] timepiece according to claim 2, further comprising a modulator for modulating said field intensity display during the actuation of [a] *said* radio receiver.

8. *An autonomous radio-controlled* [Radio] timepiece according to claim 3, further comprising a modulator for modulating said field intensity display during the actuation of [a] *said* radio receiver.

9. *An autonomous radio-controlled* [Radio] timepiece according to claim 4, further comprising a modulator for modulating said field intensity display during the actuation of [a] *said* radio receiver.

11. *An autonomous radio-controlled* [Radio] timepiece according to claim 1, further comprising means for determining the number of radio receptions said *radio* receiver has attempted but were futile, and wherein said display further indicates the number of past futile reception attempts, said indication optionally blinking during the actuation of said radio receiver.

12. *An autonomous radio-controlled* [Radio] timepiece according to claim 11, wherein said display has a [normal display mode and an] *second* auxiliary display mode, said display includes an opto-electronic display section and wherein the indication of the number of attempted receptions is provided on said opto-electronic display section when said display is manually switched to its *second* auxiliary display mode.

13. *An autonomous radio-controlled* [Radio] timepiece according to claim 12, wherein said opto-electronic display section includes day digits corresponding to current day and wherein the number of attempted receptions is indicated by at least one of the day digits of the opto-electronic display when said display is in its *second* auxiliary display mode.

15. *An autonomous radio-controlled* [Radio] timepiece according to claim [14] *1*, wherein said [display displays a time zone] *time zone information is a* difference between [a] received time information and *said manually varied registered time* [a prevailing hour of a local time zone].

16. *An autonomous radio-controlled* [Radio] timpiece according to claim [14] *1*, wherein said [display includes an electro-mechanical time display section and a] *auxiliary* digital display [section, and wherein] *displays said manually varied registered time to* [a prevailing hour of the local time zone may be displayed digitally and] serve as [the] reference information for the adjustment of [an electro-mechanical time display section] *said analog display.*

17. *An autonomous radio-controlled* [Radio] timepiece according to claim 1, further comprising:

a case for housing the radio timepiece, a wristband for securing said case to an object, an antenna for receiving radio transmissions and integrated into wristband, and a connecting device for connecting said antenna mechanically to said case and electronically to said radio timepiece, wherein said *analog* display includes an electromechanical time display and *said digital display includes* a manually switchable opto-electronic display, said opti-electronic display located, relative to the electro-mechanical display, diametrically opposite said electrical and mechanical connecting device of said antenna.

18. *An autonomous radio-controlled* [Radio] timepiece according to claim 2, further comprising a built-in power source, wherein the bar graph may be switched to display the capacity of a built-in *power* source [of power].

19. *An autonomous radio-controlled* [Radio] timepiece according to claim 1, further comprising a built-in power source, and wherein said [display includes a] *auxiliary* digital display [section with] *includes* a switchable opto-electronic display, said opto-electronic display section displaying warning information when said built-in power source is critically low.

* * * * *